United States Patent [19]

Kashiwabara et al.

[11] Patent Number: 5,050,561

[45] Date of Patent: Sep. 24, 1991

[54] AIR/FUEL RATIO CONTROL SYSTEM FOR INTERNAL COMBUSTION ENGINE WITH A HIGH DEGREE OF PRECISION IN DERIVATION OF ENGINE DRIVING CONDITION DEPENDENT CORRECTION COEFFICIENT FOR AIR/FUEL RATIO CONTROL

[75] Inventors: Masuo Kashiwabara; Yoshiki Yuzuriha, both of Gunma, Japan

[73] Assignee: Japan Electronic Control Systems Company, Isezaki, Japan

[21] Appl. No.: 491,695

[22] Filed: Mar. 12, 1990

[51] Int. Cl.[5] ..... F02M 51/00

[52] U.S. Cl. ..... 123/489; 123/1 A

[58] Field of Search ..... 123/1 A, 489, 1 R, 486, 123/575

[56] References Cited

U.S. PATENT DOCUMENTS

| | | | |
|---|---|---|---|
| 4,444,166 | 4/1984 | Kovacs et al. | 123/1 A |
| 4,546,732 | 10/1985 | Mae et al. | 123/1 A |
| 4,594,968 | 6/1986 | Degobert et al. | 123/1 A |
| 4,603,674 | 8/1986 | Tanaka | 123/575 |
| 4,646,691 | 3/1987 | Kiyota et al. | 123/1 A |
| 4,706,629 | 11/1987 | Wineland et al. | 123/478 |
| 4,706,630 | 11/1987 | Wineland et al. | 123/1 A |
| 4,711,223 | 12/1987 | Carroll | 123/1 A |
| 4,770,129 | 9/1988 | Miyata et al. | 123/1 A |
| 4,854,286 | 8/1989 | Chemnitzer | 123/1 A |
| 4,905,655 | 3/1990 | Maekawa | 123/575 |

*Primary Examiner*—Raymond A. Nelli

*Attorney, Agent, or Firm*—Foley & Lardner

[57] ABSTRACT

An air/fuel ratio control system derives a air/fuel ratio dependent correction value for correcting a basic fuel delivery amount as a proportional-integral control value composed of a proportional component and an integral component. The proportional component is derived on the basis of an air/fuel ratio indicative signal which varies the signal level when the air/fuel ratio varies across a predetermined stoichiometric value. The integral component is derived on the basis of a basic fuel delivery amount which is derived on the basis of engine speed and an engine load.

5 Claims, 2 Drawing Sheets

AIR/FUEL RATIO CONTROL SYSTEM FOR INTERNAL COMBUSTION ENGINE WITH A HIGH DEGREE OF PRECISION IN DERIVATION OF ENGINE DRIVING CONDITION DEPENDENT CORRECTION COEFFICIENT FOR AIR/FUEL RATIO CONTROL

BACKGROUND OF THE INVENTION

1. Field of the Invention

The present invention relates generally to an air/fuel ratio control system for an internal combustion engine. More specifically, the invention relates to an air/fuel ratio control system which can precisely derive a fuel delivery amount correction value.

2. Description of the Background Art

In general, air/fuel ratio control in an automotive internal combustion engine is performed by monitoring oxygen concentration in an exhaust gas from the engine and by feedback controlling the fuel delivery amount so that the air/fuel ratio in an air/fuel mixture to be introduced into the engine combustion chamber is maintained at or near an optimal or a stoichiometric value. A correction coefficient is typically derived from a proportional component and an integral component. The fuel delivery amount is basically derived on the basis of engine speed and and engine load and then corrected by various correction values respectively derived depending upon associated correction parameters. In the case of a fuel injection type internal combustion engine, the basic fuel injection amount Tp is typically expressed by:

$$Tp = k \times Q/N$$

where k is constant;

is engine load, i.e. intake air flow rate;

N is engine speed.

The basic fuel injection amount Tp is corrected by a correction coefficient $K_{COEF}$ which is a combination of a variety of correction coefficients, such as an acceleration enrichment correction coefficient, a cold engine enrichment correction coefficient and so forth, an air/fuel ratio dependent correction coefficient $K_\lambda$, a battery voltage compensating correction value Ts and so forth. Correction of the basic fuel injection amount Tp utilizing these correction values is per se well known technology in the art. The corrected fuel injection amount is used as a fuel injection amount Ti to be actually injected.

As set forth, the air/fuel ratio control by adjusting the fuel delivery amount is performed in a feedback manner depending upon the oxygen concentration in the exhaust gas and utilizing proportional-integral PI control strategy. In conventional air/fuel ratio control, the proportional component P is derived on the basis of an oxygen sensor signal level varying across a threshold level corresponding to the stoichiometric value of the air/fuel ratio. Therefore, the proportional component P is swiftly varied when the oxygen sensor signal level varies across the threhold level. According to a swift change of the proportional component P, the air/fuel ratio dependent correction coefficient $K_\lambda$ varies at a significant level. Then the air/fuel ratio dependent correction coefficient $K_\lambda$ is moderately increased or decreased at a gradient defined by the integral component I. Typically, the integral component I is derived by multiplying a basic integral component i which is derived by looking up a table in terms of the engine driving condition, by the fuel injection amount Ti.

As is set forth above, the fuel injection amount Ti is derived with various correction coefficients. Therefore, the integral component is influenced by the correction coefficients for making the air/fuel ratio dependent correction coefficient not precisely corresponding to the engine driving condition. For example, in the low engine load condition, the battery voltage compensation value Ts may be significantly influenced to make the integral component I excessively large to degrade exhaust control characteristics.

On the other hand, according to recent trends, the requirement for anti-polution control is becoming more and more strict for reducing CO, $NO_x$ and other pollutants. To comply with such a requirement, a mixture of gasoline and alcohol is interesting as a new automotive fuel for a lower exhaust rate of pollutants. On the other hand, because of the low combustibility of alcohol, the air/fuel mixture ratio has to be differentiated from that of the air/gasoline mixture ratio. Since the optimal air/fuel ratio is variable depending upon the mixture ratio of alcohol versus gasoline, correction of the fuel injection amount depending upon the alcohol/gasoline mixture ratio has to be made for obtaining optimal engine performance.

In such a case, the alcohol/gasoline mixture ratio dependent correction coefficient may provide a substantial influence on the integral component I. Therefore, the air/fuel ratio dependent correction coefficient $K_\lambda$ varies significantly when the alcohol/gasoline mixture ratio is varied.

SUMMARY OF THE INVENTION

In view of the defects and drawbacks in the prior art, it is an object of the present invention to provide an air/fuel ratio control system which can avoid the influence of variation of fuel delivery amount correction values for air/fuel ratio control.

In order to accomplish the aforementioned and other objects, an air/fuel ratio control system, according to the present invention, derives a air/fuel ratio dependent correction value for correcting a basic fuel delivery amount as a PI control value composed of a proportional component and an integral component. The proportional component is derived on the basis of an air/fuel ratio indicative signal which varies the signal level when air/fuel ratio varies across a predetermined stoichiometric value. The integral component is derived on the basis of a basic fuel delivery amount which is derived on the basis of engine speed and engine load.

According to one aspect of the invention, an air/fuel ratio control system for an internal combustion engine, comprises:

first sensor means for monitoring an engine revolution speed to produce a first sensor signal;

second sensor means for monitoring an engine load to produce a second sensor signal;

third sensor means for monitoring oxygen concentration to produce a third sensor signal;

fourth sensor means for monitoring a preselected engine driving parameter for producing a fourth sensor signal;

fifth means for deriving a fuel delivery amount on the basis of the first and second sensor signals;

sixth means for deriving a first correction value for correcting the basic fuel delivery amount, the first correction value being composed of a proportional component derived on the basis of the third sensor signal and an integral component derived on the basis of the basic fuel delivery amount; and seventh means for deriving a second correction value on the basis of the fourth sensor signal; and eighth means for deriving a fuel delivery amount by correcting the basic fuel delivery amount by the first and second correction values so as to control a fuel amount to be delivered to an engine combustion chamber.

The seventh means may detect an engine driving condition satisfying a predetermined condition for deriving the first correction value on the basis of the third sensor signal and the basic fuel delivery amount when the predetermined condition is satisfied, and otherwise sets the first correction value at a predetermined value.

According to another aspect of the invention, an air/fuel ratio control system for an internal combustion engine adapted for combustion with a fuel mixture of gasoline and alcohol, comprises:

an engine speed sensor means for monitoring an engine revolution speed to produce a first sensor signal;

an engine load sensor means for monitoring an engine load to produce a second sensor signal;

an oxygen concentration sensor means for monitoring oxygen concentration to produce a third sensor signal;

a correction factor sensor means for monitoring a preselected fuel delivery correction parameter for producing a fourth sensor signal;

an alcohol ratio sensing means for detecting the ratio of alcohol in the fuel for producing a fifth sensor signal;

means for deriving a fuel delivery amount on the basis of the first and second sensor signal;

means for deriving a first correction value for correcting the basic fuel delivery amount, the first correction value being composed of a proportional component derived on the basis of the third sensor signal and an integral component derived on the basis of the basic fuel delivery amount;

means for deriving a second correction value on the basis of the fourth sensor signal;

means for deriving a third correction value on the basis of the fifth sensor signal; and eighth means for deriving a fuel delivery amount by correcting the basic fuel delivery amount by the first and second correction values so as to control a fuel amount to be delivered to an engine combustion chamber.

BRIEF DESCRIPTION OF THE DRAWINGS

The present invention will be understood more fully from the detailed description given herebelow and from the accompanying drawings of the preferred embodiment of the present invention, which, however, should not be taken to limit the invention to the specific embodiment, but are for explanation and understanding only.

In the drawings.

DESCRIPTION OF THE PREFERRED EMBODIMENT

Figure 1:
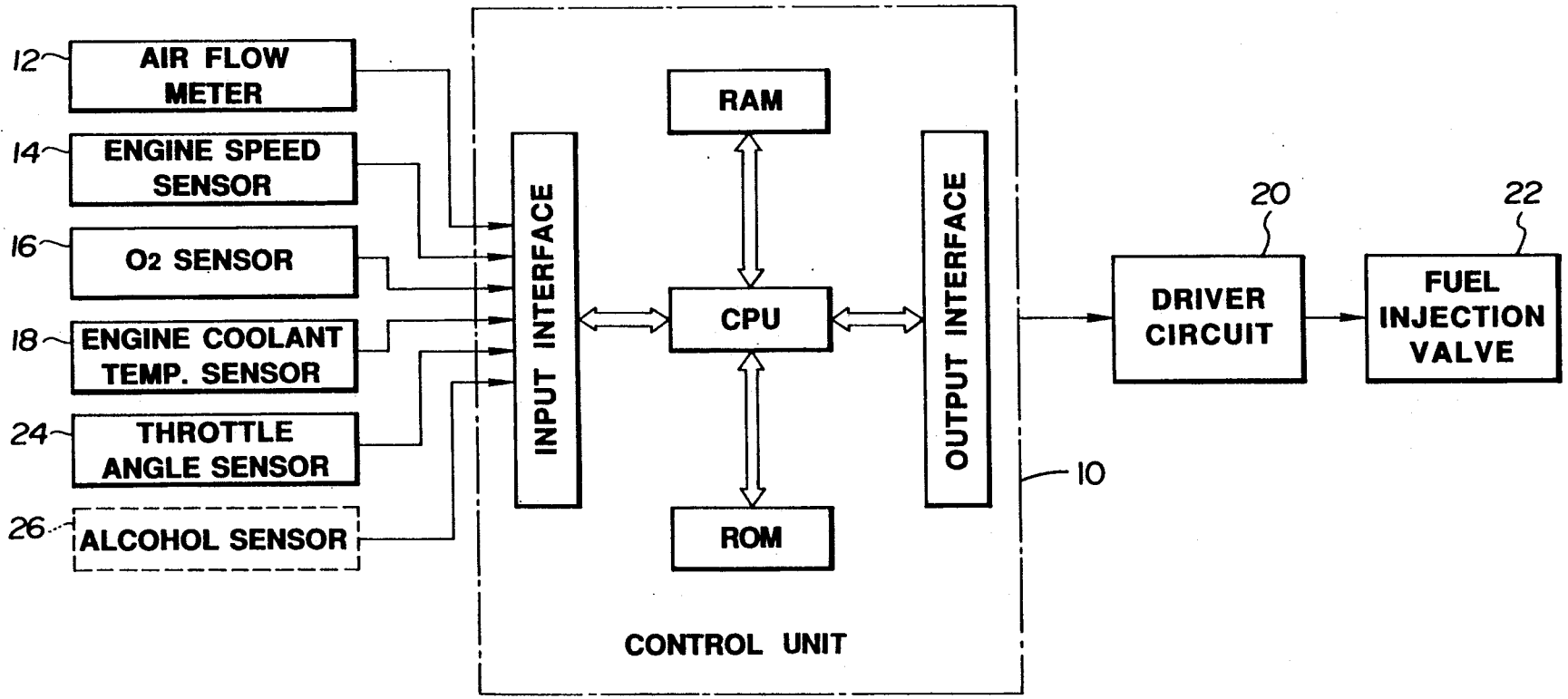
FIG. 1 is a block diagram of a typical construction of a fuel injection control system for which the preferred process for air/fuel ratio control strategy according to the present invention, is applied.

Referring now to the drawings, particularly to FIG. 1, a fuel injection control system generally comprises a microprocessor based control unit 10 connected to various sensors which monitor preselected fuel injection control parameters. In the embodiment shown, there are an air flow meter 12, an engine speed sensor 14, an oxygen sensor 16 and an engine coolant temperature sensor 18. The air flow meter 12 monitors an air induction system for the internal combustion engine to monitor the flow rate of intake air. The air flow meter 12 produces an intake air flow rate indicative signal Q representative of the monitored intake air flow rate which serves as engine load indicative data. The engine speed sensor 14 generally comprises a crank angle sensor for monitoring a crankshaft angular position to produce a crank reference signal at predetermined crankshaft reference positions and a crank position signal at every predetermined angle, e.g. 1° of crankshaft angular displacement. The engine speed sensor 14 may further includes an arithmetic circuit for deriving engine speed data N based on the frequency or pulse period of one of the crank reference signal and the crank position signal. The oxygen sensor 16 is disposed within an exhaust passage of the engine for monitoring oxygen concentration in exhaust gas flowing through the exhaust passage. The oxygen sensor 16 thus outputs an oxygen concentration indicative signal λ. The oxygen concentration indicative signal varies between HIGH level and LOW level when oxygen concentration in the exhaust gas is varied across a threshold value representative of the stoichiometric value of the air/fuel ratio. Therefore, the oxygen concentration indicative signal λ serves as air/fuel ratio indicative data. The engine coolant temperature sensor 18 is disposed within a water jacket in an engine cylinder block for monitoring the temperature of the engine coolant. The engine coolant temperature sensor 18 produces an engine coolant temperature indicative signal Tw.

Although the embodiment shown of the fuel injection control system includes sensors as set forth above, various other sensors for providing additional fuel injection control parameter data may also be employed for more precise control of the engine operation.

The control unit 10 processes the input signals from the air flow meter 12, the engine speed sensor 14, the oxygen sensor 16 and the engine coolant temperature sensor 18 to produce a fuel injection control pulse having a pulse width representative of the period for injecting fuel. The fuel injection control pulse output from the control unit 10 is fed to a driver circuit 20 which is, in turn, connected to a fuel injection valve 22. The driver circuit 20 drives the fuel injection valve 22 for opening the valve at a given time and duration corresponding to the fuel injection pulse.

Figure 3:
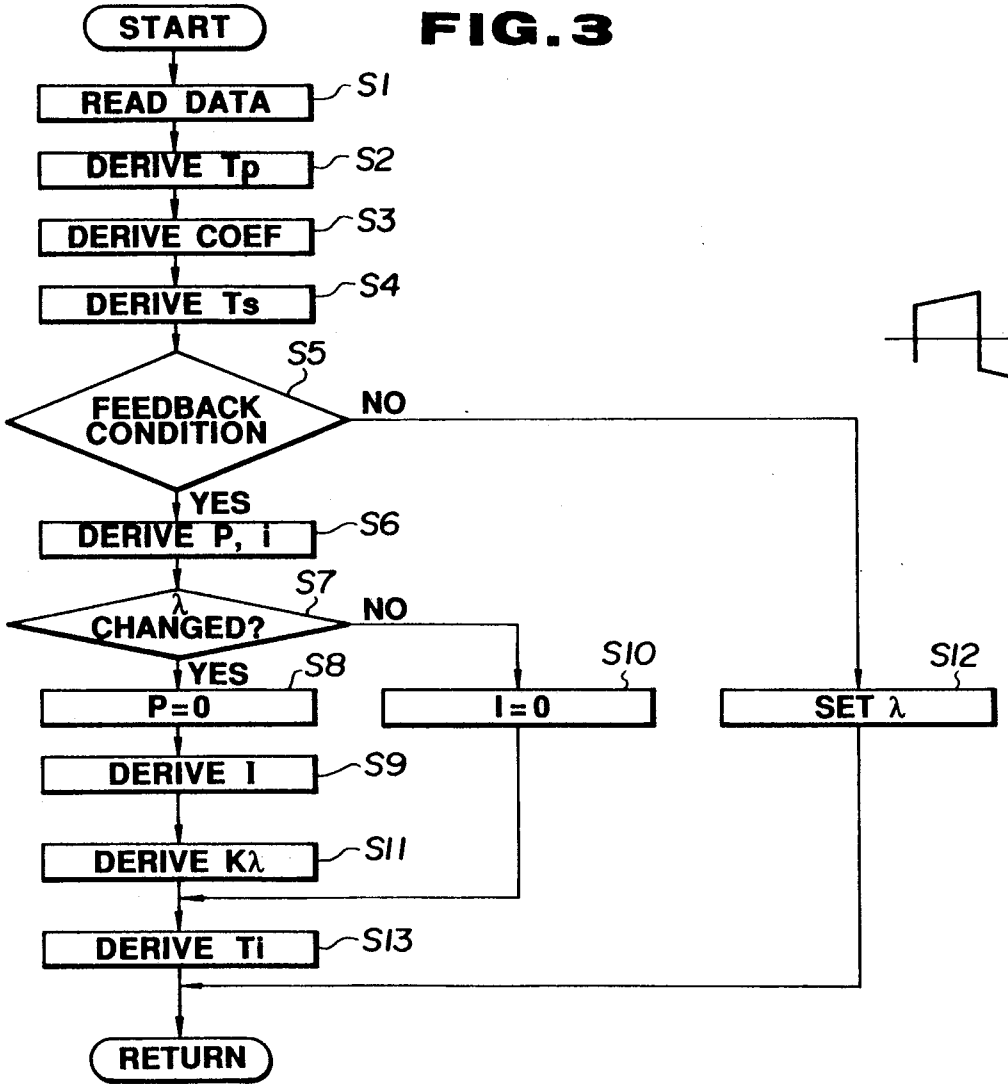
FIG. 3 is a flowchart of a fuel injection control routine to be executed by the preferred embodiment of the fuel.

FIG. 3 shows a process of a fuel injection control routine to be executed by the control unit 10. The routine shown is executed at every predetermined time for deriving a fuel injection amount Ti.

At a step S1, the input signals, i.e. the intake air flow rate indicative signal Q, the engine speed indicative signal N, the oxygen concentration indicative signal λ and the engine coolant temperature indicative signal Tw, are read out. At a step S2, a basic fuel injection amount Tp is arithmetically derived on the basis of the engine speed indicative signal N and the intake air flow rate indicative signal Q in per se well known manner as expressed by:

$$Tp = k \times Q/N$$

At a step S3, correction coefficient COEF is derived. The correction coefficient COEF is a combination of various fuel injection control coefficients, such as an engine coolant temperature dependent correction coefficient, an acceleration enrichment correction coefficient and so forth. The manner of derivation of the correction coefficient is know in the art. The correction parameters can be selected in any way as required. At a step S4, a battery voltage compensating correction value Ts for compensating an ineffective pulse width at the rising edge of the fuel injection pulse is derived.

At a step S5, the engine driving condition is checked to determine whether a predetermined feedback condition is satisfied. Namely, in general, the air/fuel ratio dependent fuel injection control can be performed at steady state of the engine, moderate acceleration and deceleration state at relatively low vehicle speed, the warmed engine state in which the engine coolant temperature is satisfactorily high, and normal operation state of the oxygen sensor are required to be satisfied for performing the air/fuel ratio dependent feedback control. Therefore, at the step S5, the engine coolant temperature indicative signal Tw is checked to determine whether the signal value thereof is greater than or equal to a predetermined cold engine criterion. Also, at the step S5, a throttle valve angular position indicative signal TVO monitored by a throttle angle sensor 24 is checked to determine whether the signal value thereof is smaller than or equal to a predetermined throttle angle criterion. At the step S5, it is further checked to determine whether the throttle valve open angle variation rate is not greater than a predetermined swift acceleration or deceleration criterion. When the aforementioned conditions are satisfied, a judgement is made that the engine operating condition satisfies the feedback condition.

When the engine driving condition as checked at the step S5, satisfies the feedback condition, then, at a step S6, table look up is performed for deriving the proportional component P of the air/fuel ratio dependent correction coefficient $K_\lambda$ on the basis of the oxygen concentration indicative signal λ. Also, at this step, the basic integral component i is derived by map look up in terms of the engine driving condition represented by preselected parameters. As parameters for deriving the basic integral component i, the engine driving condition representative parameters which are used in derivation of the basic integral component in the conventional process may be used.

If the embodiment shown, a proportional constant for deriving the proportional component P is set at a maximum value upon initiation of the feedback control of air/fuel ratio and is gradually decreased according to the expansion of elapsed time. The proportional constant becomes constant after the expiration of a predetermined period after initiation of feedback control.

At a step S7, a check is performed to determine whether the oxygen concentration signal value λ varies across the threshold value. As set forth, since the oxygen concentration indicative signal varies between HIGH level and LOW level across the threshold value, a check at the step S7 is performed by detecting the change of the oxygen concentration indicative signal level. If a change of the oxygen concentration indicative signal level is not detected, the proportional component P is set at zero (0) at a step S8. Thereafter, the integral component I is derived by:

$$I = i + 2Tp$$

On the other hand, if a change of the oxygen concentration indicative signal level is detected at the step S7, then the integral component I is set at zero (0) at a step S10. After the process in one of the steps S9 and S10, the air/fuel ratio dependent correction coefficient $k_\lambda$ is arithmetically derived at a step S11. In the process at the step S11, the proportional component P and the integral component I are added to the correction coefficient $k_\lambda$ derived in the immediately proceeding process cycle.

Figure 2:
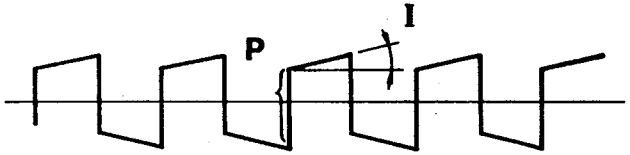
FIG. 2 is a chart showing variation of an air/fuel ratio dependent correction value for correcting a basic fuel injection amount.

As will be seen from FIG. 2, in the shown process, the proportional component I is varied in a significant magnitude upon changing of the oxygen concentration indicative signal λ. According to variation of the proportional component P, the air/fuel ratio dependent correction coefficient $k_\lambda$ is varied substantially. On the other hand, the integral component I varies moderately in a gradient defined by the basic fuel injection amount $T_p$.

On the other hand, if the engine driving condition as checked at the step S5 does not satisfy the feedback condition, then, the air/fuel ratio dependent correction coefficient $k_\lambda$ is set at a predetermined fixed value $k_{\lambda fix}$ at a step S12.

After the process of the step S11 or S12, correction for the basic fuel injection amount Tp is performed by utilizing the correction values COEF derived at the step S3, Ts derived at the step S4 and the air/fuel ratio dependent correction coefficient $k_\lambda$ derived at one of the step S11 and S12, for deriving a final fuel injection amount Ti.

As will be appreciated herefrom, since the present invention derives the air/fuel ratio dependent correction coefficient for the fuel injection amount on the basis of the basic fuel injection amount Tp, conditions of other correction factors, such as battery voltage, mixture ratio of alcohol versus gasoline and so forth should not influence the derived correction coefficient. Such a process is particularly important in case the mixture of alcohol and gasoline is used as a composite fuel for the engine. For instance, in case of the fuel injection control system adapted for the alcohol/gasoline mixture fuel, a detector 26 as illustrated by broken line in FIG. 1 will be employed for detecting the proportion of alcohol versus gasoline. In such case, the optimal air/fuel ratio varies according to the alcohol ratio in the fuel. In addition, because of the low combustibility of alcohol, the fuel injection amount has to be increased in comparison with that of a pure gasoline fuel. Therefore, in the case of an engine adapted for an alcohol/gasoline mixture, the fuel injection amount has to be corrected with an alcohol ratio dependent correction coefficient. Since the alcohol ratio dependent correction coefficient is a relatively large value for causing a substantial change of the final fuel injection amount Ti, the influence of this alcohol ratio dependent correction coefficient for the air/fuel ratio dependent correction coefficient derived in the conventional process will become substantial.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. An air/fuel ratio control system for an internal combustion engine, comprising:

first sensor means for monitoring an engine revolution speed to produce a first sensor signal;

second sensor means for monitoring an engine load to produce a second sensor signal;

third sensor means for monitoring oxygen concentration to produce a third sensor signal;

fourth means for deriving a basic fuel delivery amount on the basis of said first and second sensor signals;

fifth means for deriving a first correction value used for correcting said basic fuel delivery amount through proportional-integral control, said first correction value being composed of a proportional component and an integral component, said integral component being corrected on the basis of said basic fuel delivery amount;

sixth means for deriving a second correction value used for correcting said basic fuel delivery amount on the basis of engine driving conditions; and seventh means for deriving a fuel delivery amount by correcting said basic fuel delivery amount on the basis of said first and second correction values so as to control a fuel amount to be delivered to an engine combustion chamber.

2. An air/fuel ratio control system as set forth in claim 1, wherein said fifth means detects an engine driving condition satisfying a predetermined condition for deriving said first correction value on the basis of said third sensor signal and said basic fuel delivery amount when said predetermined condition is satisfied, and otherwise setting said first correction value at a predetermined value.

3. An air/fuel ratio control system for an internal combustion engine adapted for combustion with a fuel mixture of gasoline and alcohol, comprising:

engine speed sensor means for monitoring an engine revolution speed to produce a first sensor signal;

engine load sensor means for monitoring an engine load to produce a second sensor signal;

oxygen concentration sensor means for monitoring oxygen concentration to produce a third sensor signal;

alcohol ratio sensing means for detecting a ratio of alcohol in said fuel mixture for producing a fourth sensor signal;

means for deriving a basic fuel delivery amount on the basis of said first and second sensor signals;

means for deriving a first correction value used for correcting said basic fuel delivery amount through proportional-integral control, said first correction value being composed of a proportional component and an integral component, said integral component being corrected on the basis of said basic fuel delivery amount;

means for deriving a second correction value used for correcting said basic fuel delivery amount on the basis of engine driving conditions;

means for deriving a third correction value on the basis of said fourth sensor signal; and means for deriving a fuel delivery amount by correcting said basic fuel delivery amount on the basis of said first and second correction values so as to control a fuel amount to be delivered to an engine combustion chamber.

4. An air/fuel ratio control system as set forth in claim 3, wherein said means for deriving said first correction value detects an engine driving condition satisfying a predetermined condition for deriving said first correction value on the basis of said third sensor signal and said basic fuel delivery amount when said predetermined condition is satisfied, and otherwise sets said first correction value at a predetermined value.

5. An air/fuel ratio control system for an internal combustion engine, comprising:

basic fuel delivery amount setting means for setting a basic fuel delivery amount on the basis of an engine driving condition;

correction values setting means for setting various correction values for correcting said basic fuel delivery amount;

air/fuel ratio detecting means for detecting an air/fuel ratio of an air/fuel mixture to be introduced into a combustion chamber of said engine;

feedback correction value setting means for setting a feedback correction value for correcting said basic fuel delivery amount through proportional-integral control, said feedback correction value being comprised of a proportional component and an integral component;

integral component setting means for setting said integral component on the basis of said basic fuel delivery amount;

fuel delivery amount setting means for setting a set fuel delivery amount on the basis of said feedback correction value, said various correction values and said basic fuel delivery amount; and deriving means for deriving a fuel supply amount on the basis of said set fuel delivery amount.

* * * * *